US005857514A

United States Patent [19]

Shook et al.

[11] Patent Number: 5,857,514

[45] Date of Patent: Jan. 12, 1999

[54] STRIP CASTING

[75] Inventors: Andrew Arthur Shook, Adamstown Heights; Stephen Bruce Leabeater, Albion Park, both of Australia

[73] Assignees: Ishikawajima-Harima Heavy Industries Company Limited, Tokyo, Japan; BHP Steel (JLA) PTY LTD, Melbourne, Australia

[21] Appl. No.: 710,257

[22] Filed: Sep. 13, 1996

[30] Foreign Application Priority Data

Sep. 14, 1995 [AU] Australia ..... PN5450

[51] Int. Cl.[6] ..... B22D 11/06; B22D 11/10

[52] U.S. Cl. ..... 164/480; 164/428; 164/437; 222/594; 222/606

[58] Field of Search ..... 164/428, 480, 164/437, 337; 222/591, 594, 606

[56] References Cited

FOREIGN PATENT DOCUMENTS

| | | | |
|---|---|---|---|
| 64-5648 | 1/1989 | Japan | 164/437 |
| 64-5650 | 1/1989 | Japan | 164/489 |
| 1101325 | 7/1984 | U.S.S.R. | 164/437 |

*Primary Examiner*—Kuang Y. Lin

*Attorney, Agent, or Firm*—Nikaido, Marmelstein, Murray & Oram LLP

[57] ABSTRACT

A metal delivery nozzle (19) for delivery of molten metal to the nip between casting rolls in a twin roll caster to establish a casting pool supported above the nip. The trough (19) defines an open topped trough (61) to receive molten metal from a distributor. The bottom of the trough (61) is closed and the nozzle has side openings (64) and two large end openings (71) for delivery of molten metal from the trough (61) into the casting pool. The side openings (64) are longitudinally spaced circular holes disposed between unperforated end regions (72) of the nozzle.

15 Claims, 5 Drawing Sheets

STRIP CASTING

BACKGROUND OF THE INVENTION

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals which have high solidification temperatures and tend to produce defects caused by uneven solidification at the chilled casting surfaces of the rolls. Much attention has therefore been given to the design of metal delivery nozzles aimed at producing a smooth even flow of metal to and within the casting pool. U.S. Pat. Nos. 5,178,205 and 5,238,050 both disclose arrangements in which the delivery nozzle extends below the surface of the casting pool and incorporates means to reduce the kinetic energy of the molten metal flowing downwardly through the nozzle to a slot outlet at the submerged bottom end of the nozzle. In the arrangement disclosed in U.S. Pat. No. 5,178,205 the kinetic energy is reduced by a flow diffuser having a multiplicity of flow passages and a baffle located above the diffuser. Below the diffuser the molten metal moves slowly and evenly out through the outlet slot into the casting pool with minimum disturbance. In the arrangement disclosed in U.S. Pat. No. 5,238,050 streams of molten metal are allowed to fall so as to impinge on a sloping side wall surface of the nozzle at an acute angle of impingement so that the metal adheres to the side wall surface to form a flowing sheet which is directed into an outlet flow passage. Again the aim is to produce a slowly moving even flow from the bottom of the delivery nozzle so as to produce minimum disruption of the casting pool.

Japanese Patent Publication 5-70537 of Nippon Steel Corporation also discloses a delivery nozzle aimed at producing a slow moving even flow of metal into the casting pool. The nozzle is fitted with a porous baffle/diffuser to remove kinetic energy from the downwardly flowing molten metal which then flows into the casting pool through a series of apertures in the side walls of the nozzle. The apertures are angled in such a way as to direct the in-flowing metal along the casting surfaces of the rolls longitudinally of the nip. More specifically, the apertures on one side of the nozzle direct the in-flowing metal longitudinally of the nip in one direction and the apertures on the other side direct the in-flowing metal in the other longitudinal direction with the intention of creating a smooth even flow along the casting surfaces with minimum disturbance of the pool surface.

After an extensive testing program we have determined that a major cause of defects is premature solidification of molten metal in the regions where the pool surface meets the casting surfaces of the rolls, generally known as the "meniscus" or "meniscus regions" of the pool. The molten metal in each of these regions flows towards the adjacent casting surface and if solidification occurs before the metal has made uniform contact with the roll surface it tends to produce irregular initial heat transfer between the roll and the shell with the resultant formation of surface defects, such as depressions, ripple marks, cold shuts or cracks.

Previous attempts to produce a very even flow of molten metal into the pool have to some extent exacerbated the problem of premature solidification by directing the incoming metal away from the regions at which the metal first solidifies to form the shell surfaces which eventually become the outer surfaces of the resulting strip. Accordingly, the temperature of the metal in the surface region of the casting pool between the rolls is significantly lower than that of the incoming metal. If the temperature of the molten metal at the pool surface in the region of the meniscus becomes too low then cracks and "meniscus marks" (marks on the strip caused by the meniscus freezing while the pool level is uneven) are very likely to occur. One way of dealing with this problem has been to employ a high level of superheat in the incoming metal so that it can cool within the casting pool without reaching solidification temperatures before it reaches the casting surfaces of the rolls. In recent times, however, it has been recognised that the problem can be addressed more efficiently by taking steps to ensure that the incoming molten metal is delivered relatively quickly by the nozzle directly into the meniscus regions of the casting pool. This minimises the tendency for premature freezing of the metal before it contacts the casting roll surfaces. It has been found that this is a far more effective way to avoid surface defects than to provide absolutely steady flow in the pool and that a certain degree of fluctuation in the pool surface can be tolerated since the metal does not solidify until it contacts the roll surface. An example of this approach is to be seen in Japanese Patent Publication No 64-5650 of Nippon Steel Corporation.

Although the direction of molten metal from the delivery nozzle directly to the meniscus regions of the casting pool allows casting with molten metal supplied with relatively low level of superheat without the formation of surface cracks, problems can arise due to the formation of pieces of solid metal known as "skulls" in the vicinity of the pool confining side plates or dams. These problems are exacerbated as the superheat of the incoming molten metal is reduced. The rate of heat loss from the melt pool is greatest near the side dams due primarily to additional conductive heat transfer through the side dams to the roll ends. This high rate of local heat loss is reflected in the tendency to form "skulls" of solid metal in this region which can grow to a considerable size and fall between the rolls causing defects in the strip. Because the net rate of heat loss is higher near the side dams the rate of heat input to these regions must be increased if skulls are to be prevented. There have been previous proposals to provide an increased flow of metal to these "triple point" regions by forming galleries in the upper part of a delivery nozzle which receive a separate flow of metal from the tundish as seen for example in the delivery nozzle disclosed in our granted U.S. Pat. No. 5,221,511. However, this requires the formation of complex gallery passages and a high level of superheat of the molten metal because of cooling of the metal in the galleries. By the present invention the necessary increase in net heat input can be achieved by the simple expedite of increasing the supply of molten metal to the end regions of the roll by flow of molten metal through outlets formed in the two ends of the nozzle.

SUMMARY OF THE INVENTION

According to the invention there is provided a method of casting metal strip comprising:

introducing molten metal between a pair of chilled casting rolls via an elongate metal delivery nozzle disposed above and extending along the nip between the rolls to form a casting pool of molten metal supported above the nip and confined at the ends of the nip by pool confining end closures, and rotating the rolls so as to cast a solidified strip delivered downwardly from the nip;

wherein the bottom of the nozzle trough is closed and molten metal is caused to flow from the trough into the casting pool through side openings in the longitudinal side walls and end openings in the two end walls of the trough such that molten metal contacting the casting surfaces of the rolls in the vicinity of the roll ends is supplied from the said end openings in the end walls of the trough.

Preferably, the molten metal flows from the nozzle through said side wall openings in mutually oppositely directed jet streams directed normally outwardly of the elongate delivery nozzle to impinge directly on the casting surfaces of the rolls in the vicinity of the casting pool surface throughout a major part of the length of the nozzle extending between the end regions of the casting surfaces which are supplied with molten metal from the end openings of the nozzle.

Preferably further, the longitudinal side wall openings are in the form of longitudinally spaced openings formed in each of the longitudinal side walls of the nozzle.

Preferably further, the side wall openings are circular holes.

Preferably, the casting roll surfaces are supplied with molten metal from the nozzle end openings through a distance of at least 130 mm from the roll ends. More particularly, it is preferred that said distance be in the range 140 to 150 mm and for optimum results this distance should be about 145 mm.

Preferably, the pool end closures comprise a pair of refractory plates which dam the ends of the casting pool and each end wall of the delivery nozzle trough is spaced from the adjacent closure plate by no more than 20 mm. It is preferred that the spacing between the nozzle end walls and the pool confining plates be of the order of 10 mm during the flow of molten metal from the end openings of the delivery nozzle.

The end openings of the delivery nozzle may be of such size as to provide negligible resistance to outflow of molten metal therethrough. They may for example be about 35 mm high and diverge upwardly to upper parts about 90 mm wide.

The trough of the delivery nozzle may be supplied with molten metal in a series of discrete free falling streams spaced apart longitudinally of the trough or in a free-falling continuous curtain stream extending along the trough. In either case, the molten metal may fall directly into the trough to form a reservoir and to flow within the reservoir without obstruction to the side openings and end openings of the nozzle. Alternatively, molten metal could be supplied into the trough of the delivery nozzle by means of a submerged entry nozzle.

The invention also provides apparatus for casting metal strip, comprising a pair of a parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle, wherein the metal delivery nozzle comprises an upwardly opening elongate inlet trough extending longitudinally of the nip to receive molten metal from the distributor, the bottom of the trough is closed and the delivery nozzle is provided with side openings in the longitudinal side walls of the trough and end openings in the two end walls of the trough for flow of molten metal outwardly from the sides and from the ends of the nozzle.

The invention further provides a refractory nozzle for delivery of molten metal to a casting pool of a twin-roll caster, said nozzle comprising an elongate open-topped trough to receive molten metal and having a pair of longitudinal side walls, a pair of end walls and a floor which closes the bottom of the trough, wherein said side walls are provided with side openings and said end walls are provided with end openings for flow of molten metal from the trough outwardly from the sides and from the ends of the nozzle.

BRIEF DESCRIPTION OF DRAWINGS

In order that the invention may be more fully explained one particular method and apparatus will be described in some detail with reference to the accompanying drawings in which.

DESCRIPTION OF PREFERRED EMBODIMENT

Figure 1:
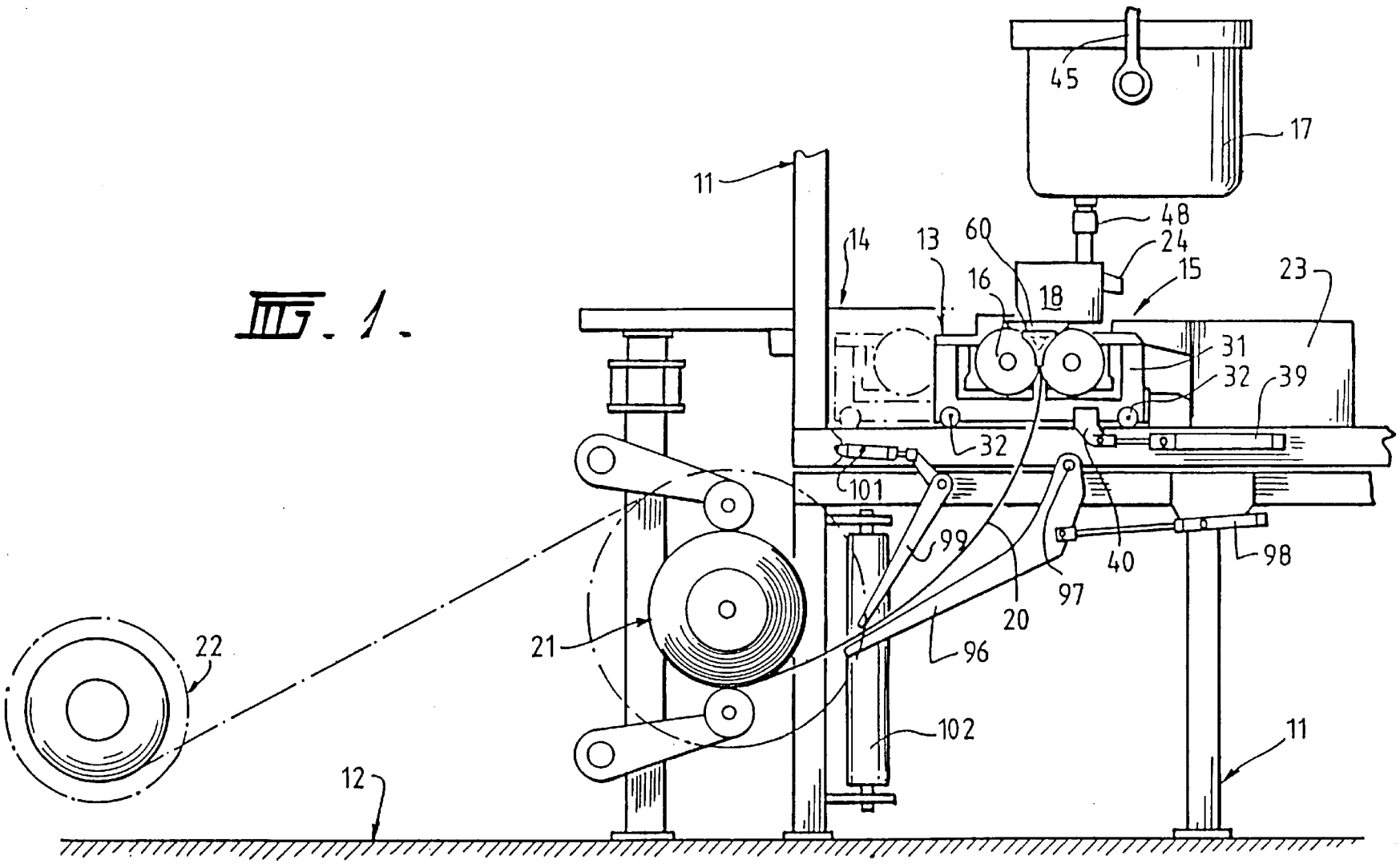
FIG. 1 illustrates a twin-roll continuous strip caster constructed and operating in accordance with the present invention.
Figure 2:
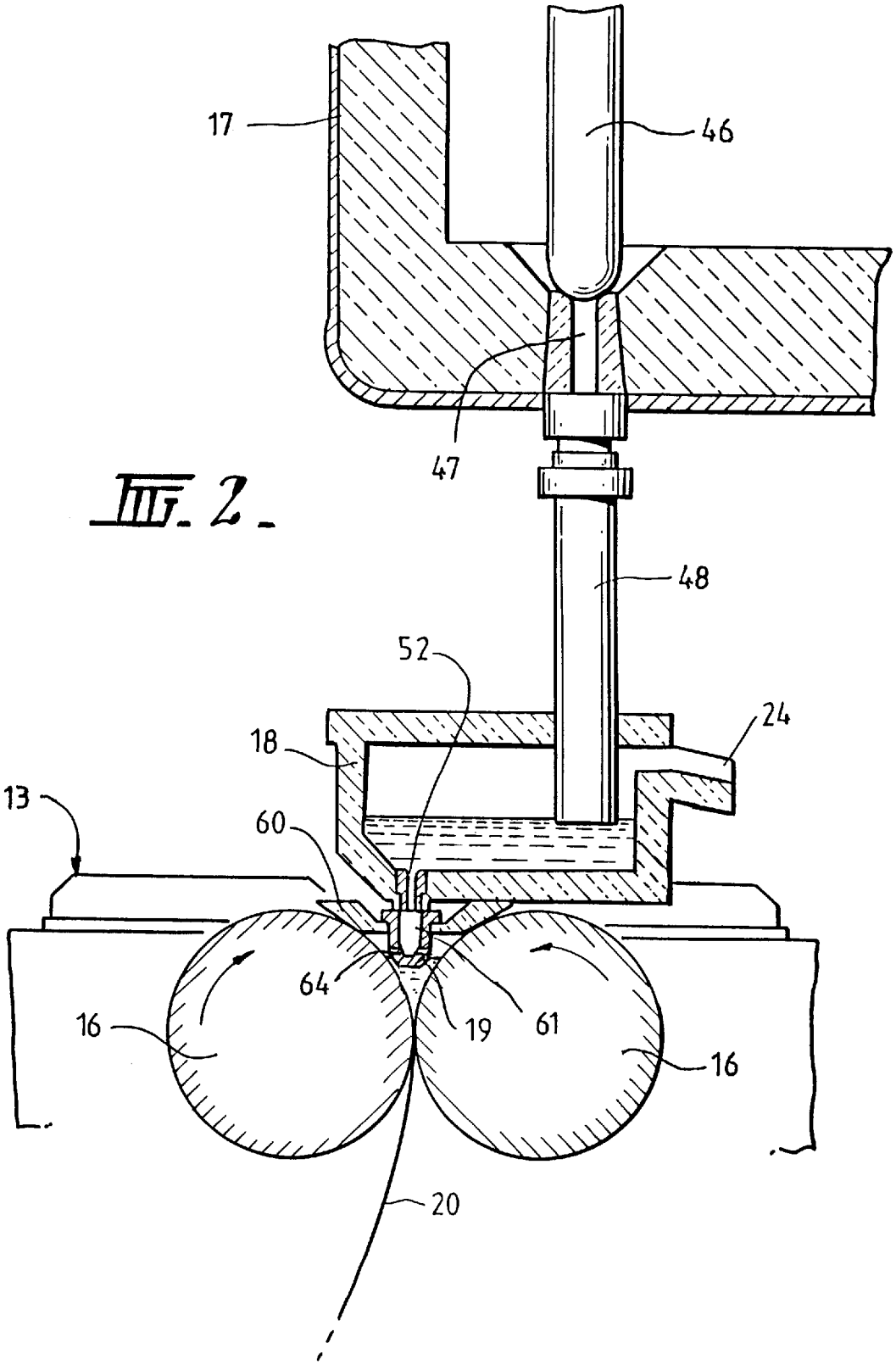
FIG. 2 is a vertical cross-section through important components of the caster illustrated in FIG. 1 including a metal delivery nozzle constructed in accordance with the invention.
Figure 3:
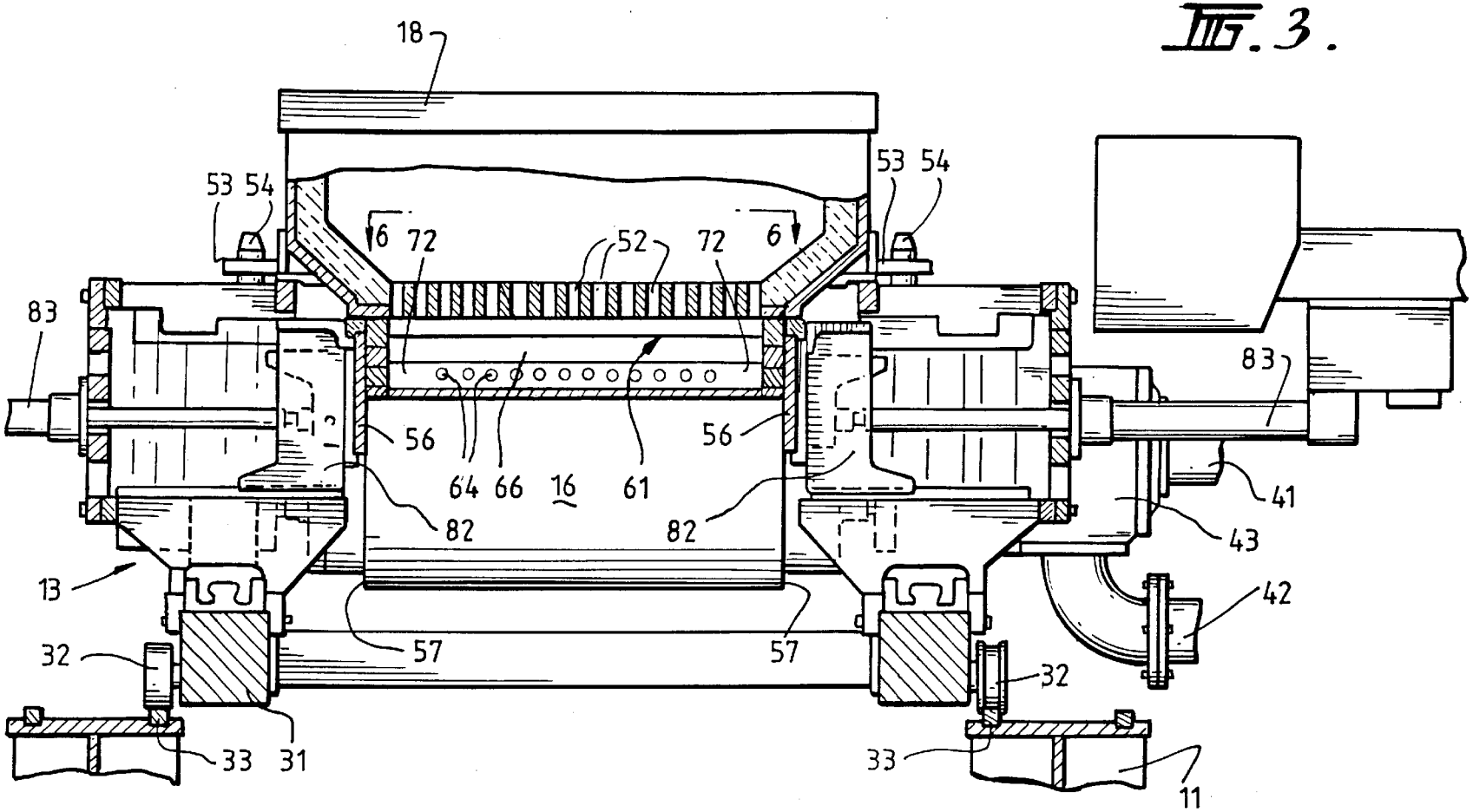
FIG. 3 is a further vertical cross-section through important components of the caster taken transverse to the section of FIG. 2.
Figure 4:
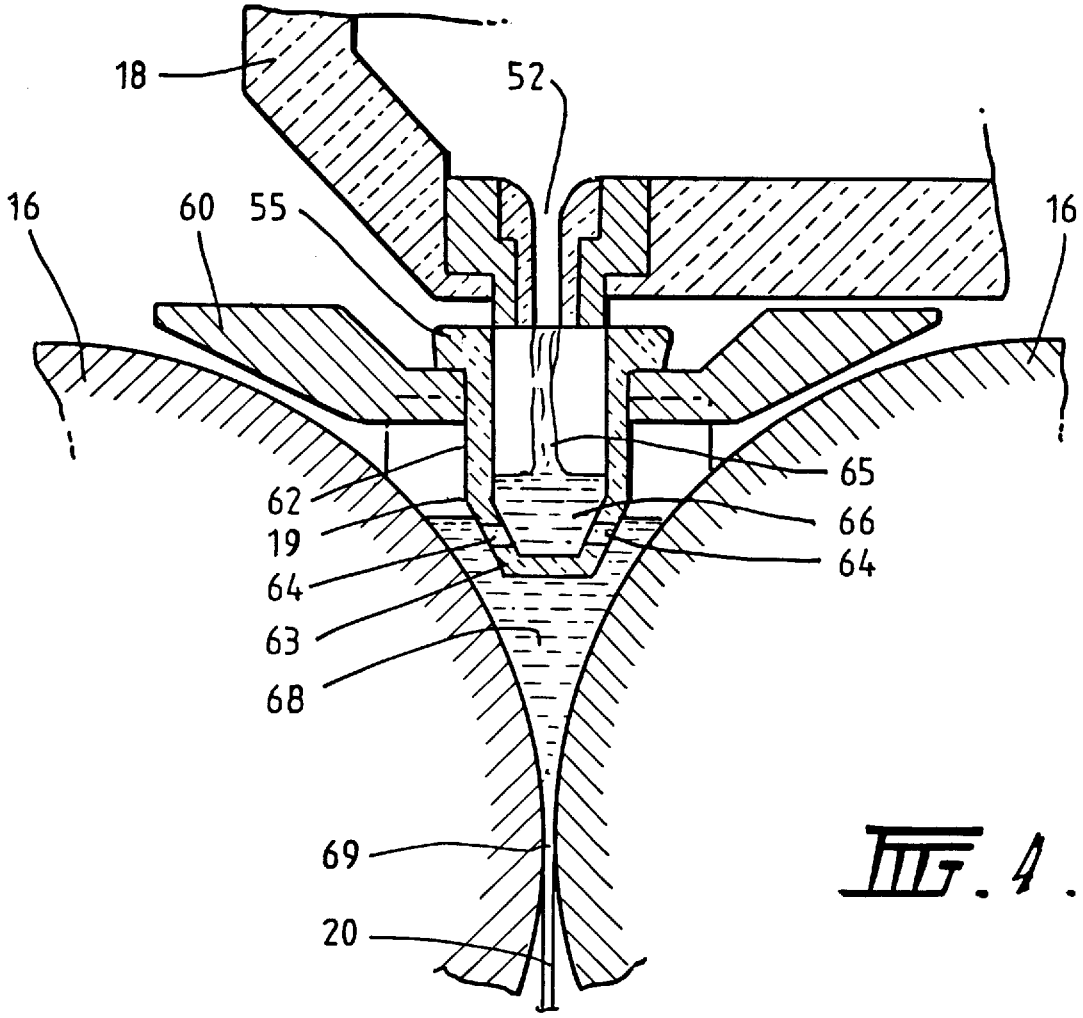
FIG. 4 is an enlarged transverse cross-section through the metal delivery nozzle and adjacent parts of the casting rolls.
Figure 5:
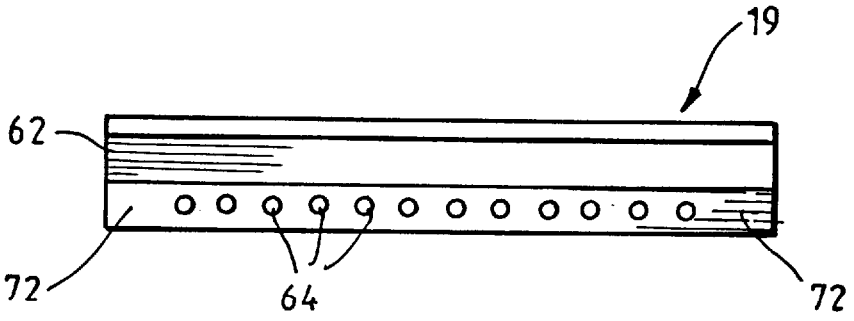
FIG. 5 is a side elevation of the metal delivery nozzle.
Figure 6:
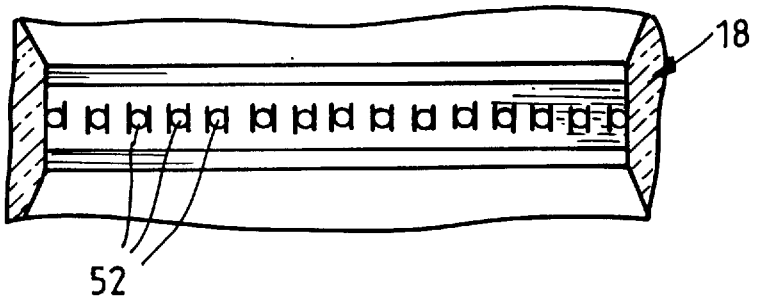
FIG. 6 is a partial plan view on the line 6—6 in FIG. 3.

The illustrated caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Carriage 13 is movable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and visa versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Delivery nozzle 19 is formed as an elongate body made of a refractory material such as alumina graphite. Its lower part is tapered so as to converge inwardly and downwardly so that it can project into the nip between casting rolls 16. A mounting bracket 60 is provided to support the nozzle on the roll carriage frame and the upper part of the nozzle is formed with outwardly projecting side flanges 55 which locate on the mounting bracket.

Delivery nozzle 19 has an upwardly opening inlet trough 61 to receive molten metal flowing downwardly through the openings 52 of the distributor. Trough 61 is formed between nozzle side walls 62 and end walls 70. The bottom of the trough is closed by a horizontal bottom floor 63. The bottom part of the longitudinal side walls 62 are downwardly convergent and are perforated by horizontally spaced openings 64 in the form of circular holes extending horizontally through the side walls. End walls 70 of the delivery nozzle are perforated by two large end holes 71.

Molten metal falls from the outlet openings 52 of the distributor in a series of free-falling vertical streams 65 to form a reservoir 66 of molten metal in the bottom part of the nozzle trough 61. Molten metal flows from this reservoir out through the side openings 64 and the end openings 71 to form a casting pool 68 supported above the nip 69 between the casting rolls 16. The casting pool is confined at the ends of rolls 16 by a pair of side closure plates 56 which are held against the ends 57 of the rolls. Side closure plates 56 are made of strong refractory material, for example boron nitride. They are mounted in plate holders 82 which are movable by actuation of a pair of hydraulic cylinder units 83 to bring the side plates into engagement with the ends of the casting rolls to form end closures for the casting pool of molten metal.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

In accordance with the present invention the delivery nozzle side openings 64 do not extend throughout the length of the delivery nozzle and the outer end parts 72 of the nozzle side walls 62 are unperforated. This ensures that molten metal contacting end regions in the vicinity of the roll ends is supplied from the delivery nozzle end openings 71 and not from the side openings 64. The nozzle end openings 71 are so large that there is negligible resistance to flow of molten metal from the ends of the nozzle trough so as to provide an over-supply of metal into the region of the casting pool near the side dam closures and some of this metal can flow backwardly from the ends of the casting rolls along the casting roll surfaces. In this way, there is a rapid delivery of excess molten metal to the end regions of the casting roll surfaces so that this metal arrives at the casting roll surfaces with minimum temperature drop to prevent the formation of skulls or to melt any skulls which do form before they can pass through the nip between the casting rolls to cause defects.

The delivery nozzle can be considered to act as a manifold, apportioning molten metal to the various regions of the casting pool. The metal flow from the nozzle to the rolls is consistent with conservation of mass—that is, each section of the rolls receives sufficient metal to produce the strip of the desired thickness. If the nozzle has negligible flow resistance, the metal will take the shortest path, resulting in no excess flow of metal to the end regions of the casting surfaces. Simply allowing metal to flow from the end of the nozzle will not induce additional metal flow above that required by solidification at the roll ends. However, because the side openings do not extend to the ends of the nozzle, there is greater resistance to flow to these regions from the side openings so causing preferential flow of metal from the end openings to produce the desired excess flow from the end openings. By this means it is possible to achieve casting with molten metal supplied at low superheats without the formation of skull defects or crack defects.

The length of the unperforated end parts of the nozzle side walls must be determined by a balance between the onset of skull defects and the onset of crack defects. If the length of the casting surfaces supplied from the end openings 71 is too long, the molten metal reaching the inner parts of these regions may cool sufficiently to produce crack defects. On the other hand, if the distance is too short the outer end regions will not receive sufficient flow from the end openings and skull defects will arise. Accordingly it is necessary to strike a balance between the onset of skull defects and crack defects which are both interrelated with the degree of superheat of the incoming molten metal. It has been found in practice that the unperforated end parts of the nozzle should be at least 130 mm long and preferably in the range 140 mm to 150 mm long. An optimum length is 145 mm. It has been found that this distance the apparatus can be operated at low superheats of the order of 1580° C. without skull formation and without surface cracks, although it is close to the maximum distance possible before the onset of surface cracking.

Figure 7:
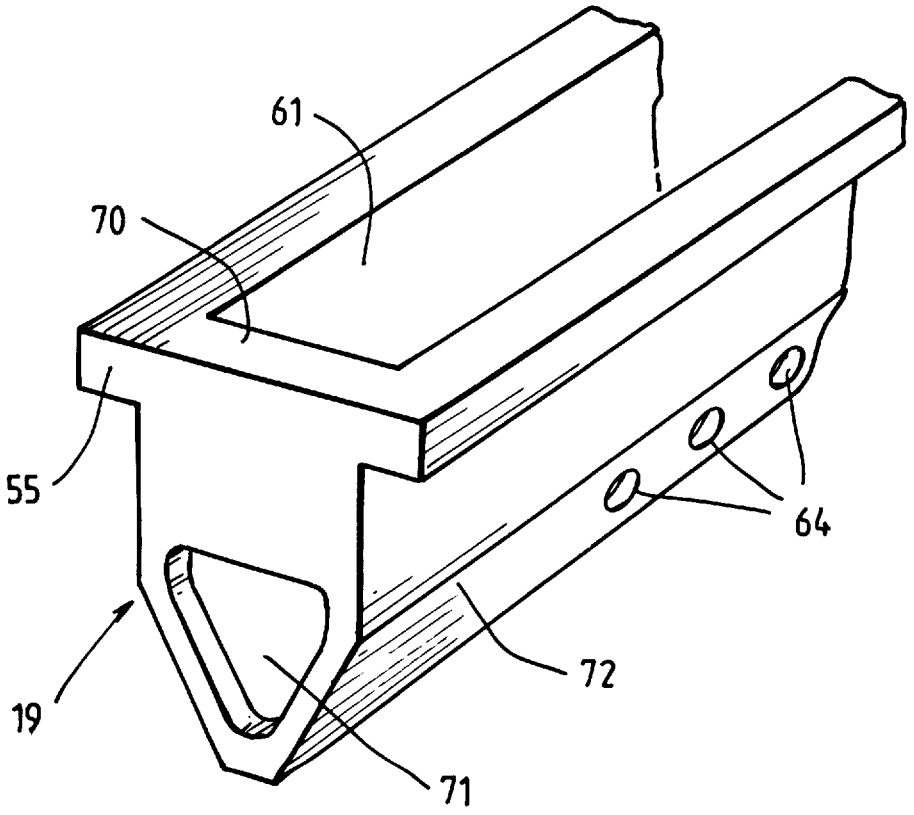
FIG. 7 is a perspective view of the delivery nozzle.

In a typical nozzle the side openings may be 15 mm diameter holes arranged at 40 mm spacing. The end holes 71 should be large enough that they present insignificant resistance to flow of molten metal but otherwise their size is not critical. As shown in FIG. 7, they may occupy most of the bottom ends of the nozzle and may be diverge upwardly to follow the nozzle profile. Typically, they may be 35 mm high and may diverge upwardly to upper parts about 90 mm wide.

To ensure adequate flow of molten metal from the end holes 71 to the end regions of the casting roll surfaces it is important that the nozzle end walls be quite close to the pool confining side dam plates 56. More specifically the distance between the nozzle end walls and the side dam plates should be no more than 20 mm during operation of the apparatus. Typically the gap between the nozzle end walls and the side dam plates may be 15 mm when the apparatus is in a cold state but reducing to 10 mm when the refractories have been heated and the apparatus is in operation.

A typical delivery nozzle for use with 800 mm casting rolls may be 770 mm long and may have a 60 mm wide trough opening. Each of the trough side walls may have thirteen 15 mm diameter holes arranged at 40 mm spacing.

The illustrated apparatus enables rapid delivery of molten metal to the meniscus regions of the pool and also to the triple point regions at the end of the pool without the complicated pouring systems of previous triple point pouring proposals. It therefore allows low superheat casting with a simple metal delivery system. However, this apparatus has been advance by way of example only and it could be modified considerably. Because the method provided by this invention does not require an elaborate metal distributor, the molten metal could be delivered to the trough of the delivery nozzle by means of a submerged entry nozzle. In this case, the submerged entry nozzle could deliver molten metal into the reservoir within the delivery nozzle trough in two jet streams flowing longitudinally of the trough toward the two end openings 71. This could enhance the flow of metal to the end regions of the casting pool and because of the jet effect it could inhibit the lateral outward flow of metal through side openings in the end regions of the nozzle. Accordingly it could be possible to achieve the desired flow of metal to the end regions of the casting surfaces from the end openings even though side openings might be provided through to the end regions of the nozzle. It is accordingly to be understood that the invention is in no way limited to details of the illustrated apparatus and that many modifications and variations will fall within its scope.

We claim:

1. A method of casting strip comprising: introducing molten metal between a pair of chilled casting rolls via an elongate metal delivery nozzle disposed above and extending along the nip between the rolls to form a casting pool of molten metal supported above the nip and confined at the ends of the nip by pool confining end closures, and rotating the rolls so as to cast a solidified strip downwardly from the nip;

wherein the bottom of the nozzle trough is closed and molten metal is caused to flow from the trough into the casting pool through side openings in the longitudinal side walls in mutually oppositely directed jet streams directed normally outwardly of the elongate delivery nozzle to impinge directly on the casting surfaces of the rolls in the vicinity of the casting pool surface and also through end openings in the two end walls of the trough which end openings are of larger effective cross-sectional area than the largest effective cross-sectional area of any of the side openings and so large as to present negligible resistance to flow of molten metal from the ends of the nozzle so that molten metal contacting the casting surfaces of the rolls in the vicinity of the roll ends is totally supplied from the end openings.

2. A method as claimed in claim 1, wherein the pool end closures comprise a pair of refractory plates which dam the ends of the casting pool at each end wall of the delivery nozzle is spaced from the adjacent closure plate by no more than 20 mm.

3. A method as claimed in claim 2, wherein the spacing between the nozzle end walls and the pool confining plates is of the order of 10 mm during the flow of molten metal from the end openings of the delivery nozzle.

4. A method as claimed in claim 1, wherein the end openings are about 35 mm high and diverge upwardly to upper parts about 90 mm wide.

5. A method as claimed in claim 1, further comprising causing the molten metal to fall directly into the trough in one or more free-falling streams to form a reservoir and to flow within the reservoir without obstruction to the side openings and to the end openings of the nozzle.

6. A method of casting strip comprising:

introducing molten metal between a pair of chilled casting rolls via an elongate metal delivery nozzle disposed above and extending along the nip between the rolls to form a casting pool of molten metal supported above the nip and confined at the ends of the nip by pool confining end closures, and rotating the rolls so as to cast a solidified strip downwardly from the nip;

wherein the bottom of the nozzle trough is closed and molten metal is caused to flow from the trough into the casting pool through side openings in the longitudinal side walls in mutually oppositely directed jet streams directed normally outwardly of the elongate delivery nozzle to impinge directly on the casting surfaces of the rolls in the vicinity of the casting pool surface and also through end openings in the two end walls of the trough which end openings are of larger effective cross-sectional area than the largest effective cross-sectional area of any of the side openings and so large as to present negligible resistance to flow of molten metal from the ends of the nozzle such that the casting roll surfaces are supplied with molten metal from the nozzle end openings through a distance of at least 130 mm from the roll ends.

7. A method as claimed in claim 6, wherein said distance is in the range 140 to 150 mm.

8. A method as claimed in claim 6, wherein the longitudinal side wall openings are in the form of longitudinally spaced openings formed in each of the longitudinal side walls of the nozzle and disposed between unperforated end regions of the nozzle which are at least 130 mm long.

9. Apparatus for casting metal strip, comprising a pair of parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle, wherein the metal delivery nozzle comprises an upwardly opening elongate inlet trough extending longitudinally of the nip to receive molten metal from the distributor, the bottom of the trough is closed and the delivery nozzle is provided with side openings in the longitudinal side walls of the trough and end openings in the two end walls of the trough for flow of molten metal outwardly from the sides and from the ends of the nozzle, the side openings being spaced longitudinally along the longitudinal side walls so as to provide for outwardly directed jet streams of molten metal therefrom and the end openings being larger than the side openings and being so large as to present negligible resistance to flow of molten metal from the ends of the nozzle so that molten metal contacting the casting surfaces of the rolls in the vicinity of the roll ends is totally supplied from the end openings.

10. Apparatus as claim in claim 9, wherein the end openings are about 35 mm high and diverge upwardly to upper parts about 90 mm wide.

11. Apparatus for casting metal strip, comprising a pair of parallel casting rolls forming a nip between them, an elongate metal delivery nozzle disposed above and extending along the nip between the casting rolls for delivery of molten metal into the nip and a distributor disposed above the delivery nozzle for supply of molten metal to the delivery nozzle, wherein the metal delivery nozzle comprises an upwardly opening elongate inlet trough extending longitudinally of the nip to receive molten metal from the distributor, the bottom of the trough is closed and the delivery nozzle is provided with side openings in the longitudinal side walls of the trough and end openings in the two end walls of the trough for flow of molten metal outwardly from the sides and from the ends of the nozzle, the side openings being spaced longitudinally along the longitudinal side walls so as to provide for outwardly directed jet streams of molten metal therefrom and the end openings being larger than the side openings and being so large as to present negligible resistance to flow of molten metal from the ends of the nozzle, and wherein the side openings do not extend throughout the length of the nozzle but are disposed between unperforated end regions of the nozzle which are at least 130 mm long.

12. Apparatus as claimed in claim 11, wherein the length of each of the unperforated end regions of the nozzle is in the range 140 to 150 mm.

13. A refractory nozzle for delivery of molten metal to a casting pool of a twin roll caster, said nozzle comprising an elongate open topped trough to receive molten metal and having a pair of longitudinal side walls, a pair of end walls and a floor which closes the bottom of the trough, wherein said side walls are provided with side openings and said end walls are provided with end openings for flow of molten metal from the trough outwardly from the sides and from the ends of the nozzle, the side openings being spaced longitudinally of the side walls and the end openings being larger than the side openings and so large as to present negligible resistance to flow of molten metal from the ends of the nozzle, said end openings being about 35 mm high and diverging upwardly to upper parts about 90 mm wide.

14. A refractory nozzle for delivery of molten metal to a casting pool of a twin roll caster, said nozzle comprising an elongate open topped trough to receive molten metal and having a pair of longitudinal side walls, a pair of end walls and a floor which closes the bottom of the trough, wherein said side walls are provided with side openings and said end walls are provided with end openings for flow of molten metal from the trough outwardly from the sides and from the ends of the nozzle, the side openings being spaced longitudinally of the side walls and the end openings being larger than the side openings and so large as to present negligible resistance to flow of molten metal from the ends of the nozzle, and wherein the side openings do not extend throughout the length of the nozzle but are disposed between unperforated end regions of the nozzle which are at least 130 mm long.

15. A refractory nozzle as claimed in claim 14, wherein the length of each of the unperforated end regions of the nozzle is in the range 140 to 150 mm.

* * * * *